United States Patent [19]

MacGregor

[11] 4,243,340

[45] Jan. 6, 1981

[54] APPARATUS FOR THE DISPLAY AND PROTECTION OF AWARDS

[75] Inventor: Donald D. MacGregor, 411 N. Madison, Bay City, Mich. 48706

[73] Assignees: Donald Dewayne MacGregor; Jean Ann MacGregor, both of Bay City, Mich.

[21] Appl. No.: 509

[22] Filed: Jan. 2, 1979

[51] Int. Cl.[3] ..... G09F 3/08

[52] U.S. Cl. ..... 40/312; 40/10 R; 40/611; 150/34; 150/35; 190/51; 190/60

[58] Field of Search ..... 40/10 R, 10 D, 306, 40/312, 586, 611, 158, 159, 152.1, 16, 16.4, 17; 150/34, 35, 39; 190/51, 60

[56] References Cited

U.S. PATENT DOCUMENTS

| | | | |
|---|---|---|---|
| 1,039,902 | 10/1912 | Cook | 190/60 UX |
| 1,490,630 | 4/1924 | Nesser | 190/60 UX |
| 1,509,776 | 9/1924 | Plimpton | 40/10 R |
| 1,610,354 | 12/1926 | Brown | 190/60 UX |
| 1,695,941 | 12/1928 | Abbey | 40/16.4 |
| 1,767,573 | 6/1930 | Braunstein | 190/60 UX |
| 2,055,852 | 9/1936 | Resnick | 150/34 |
| 2,920,671 | 1/1960 | Siris et al. | 150/35 |
| 2,925,675 | 2/1960 | Lumpkin | 40/16.4 |
| 3,400,477 | 9/1968 | Brown | 40/10 R |
| 3,759,305 | 9/1973 | McIntyre | 150/39 |
| 3,829,995 | 8/1974 | Fakoury | 40/10 RX |
| 3,999,639 | 12/1976 | Walters | 190/60 |

FOREIGN PATENT DOCUMENTS

| | | | |
|---|---|---|---|
| 504064 | 6/1951 | Belgium | 40/10 |
| 1302856 | 1/1973 | United Kingdom | 150/39 |

*Primary Examiner*—Gene Mancene
*Assistant Examiner*—G. Lee Skillington
*Attorney, Agent, or Firm*—Michael L. Bauchan

[57] ABSTRACT

Apparatus for the display and protection of awards. In a first embodiment the apparatus includes a piece of luggage having a wall containing a slit through which an award may be passed. A transparent sheet is secured to the outer surface of the wall around the slit so as to form a pocket between the wall and the sheet. A hinged cover is secured to the inside of the wall to control passage of objects through the slit. A latch is provided to seal the cover closed. In a second embodiment a substantially two-dimensional support member having a slit is provided. A transparent sheet covers one side of the support member to form a pocket therebetween. Double-sided tape covers the side of the support member opposite the sheet so that after the award is inserted in the pocket the support member is secured to the outside of a piece of luggage.

13 Claims, 8 Drawing Figures

APPARATUS FOR THE DISPLAY AND PROTECTION OF AWARDS

BACKGROUND OF THE INVENTION

Awards are given to contestants in numerous types of competitions. For example, bowlers engaged in league competition are eligible to receive a veritable plethora of awards. These awards are usually in the form of patches, which are sometimes known as chevrons, made of a semirigid cloth material of various configurations and usually fit within the perimeter of a 4" square.

Participants in other sporting activities also receive substantially two-dimensional awards. For example, different colored prize ribbons are commonly awarded in dog shows and horse shows.

In addition to awards received for performance participants in various activities also frequently purchase commercially available patches as aforedescribed having humorous quotations or other emblems. They may also acquire photographs pertaining to their activities and circle of friends.

For purposes of this application, including the specifications and accompanying claims, the term "award" is to be broadly construed to include substantially two-dimensional objects of the type above described regardless whether they are earned, purchased, manufactured, or otherwise acquired by the owner of the award.

Persons who acquire a large quantity of awards are confronted with a dilemma of how to properly display the awards. Since many awards are manufactured of a semirigid cloth the owner usually sews the award to an item of clothing apparel commonly used while the owner is engaged in the activity to which the award pertains. For example, a bowler who earns an award commonly sews the award onto a shirt or a blouse which the bowler usually wears while bowling in the league from which the award was earned. However, bowlers often participate in more than one league and often are sponsored by more than one sponsoring organization. Such a bowler usually is provided with a different shirt or blouse by each sponsor and each such garment bears the name or insignia of the sponsor across the back of the garment.

Since each sponsor naturally wants all participants to wear the garment advertising their sponsor a bowler who earns a highly prized award, such as for bowling a perfect game, as a practical matter cannot effectively display the award on a shirt or blouse while bowling for more than one sponsor as it is impractical to transfer the award to each shirt or blouse which is worn each time the bowler participates for the respective sponsors.

Anderson, U.S. Pat. No. 3,055,133 is a United States Patent which describes a transparent jacket with picture pockets which may be used for the display of numerous awards. However, such a jacket would require the wearer to add an additional article of clothing while participating in a sport and thus impede their activity. In addition, the pockets in Anderson are of a conventional design and on the inside of the jacket and are open to objects other than awards and thus would not adequately protect the awards from rain, dust, dirt, and foreign particles.

Wilson, U.S. Pat. Nos. 3,067,794 and Cook 1,039,902 are United States Patents which illustrate pieces of luggage having pockets which contain a card intended to display the name and address of the owner for ease of identification. However, neither of these patents provide a satisfactory measure of protection to effectively seal such pockets so as to prevent the introduction into such pockets of undesirable dirt and other foreign objects.

The participant in an activity often must use a piece of luggage for purposes of transporting equipment necessary to such activity. For example, a bowler usually uses a piece of luggage commonly called a bowling bag to carry his bowling ball and shoes and personal necessities to a bowling alley. A trapshooter uses gun cases to transport his firearms. Persons who show animals may use a case to transport combs, brushes, and other incidentals for maintaining the animals.

It is thus apparent that participants in numerous activities need both a piece of luggage to carry objects pertaining to their activity and a way of displaying awards pertaining to said activity. Such luggage is customized for the needs of the user but in general, and for purposes of this specification and accompanying claims, a piece of luggage is any substantially closed container which is adapted to be carried by hand.

It is therefore an object of this invention to provide apparatus for the display and protection of an award in which a piece of luggage is provided with sealed pockets in which an award may be inserted for viewing from outside the luggage and which may be securely sealed to prevent foreign particles from entering the pocket containing the award.

It is a further object of this invention to provide a piece of luggage having a sealed pocket for display of an award outside the luggage and having a hinged cover inside the luggage for sealing the pocket closed to prevent foreign particles passing from inside the luggage into the pocket.

It is a further object of this invention to provide a piece of luggage having a sealed pocket to hold and display an award on the outside of the luggage and a cover which may be securely latched to prevent foreign particles from entering the pocket.

It is a further object of this invention to provide apparatus for the display and protection of an award which includes a piece of luggage in a pocket formed between a transparent sheet and a support member having a slit for insertion of an award, the pocket being attached to the luggage by double sided tape.

The foregoing and other objects and advantages of this invention will become apparent from the accompanying drawings and from the following description.

SUMMARY OF THE INVENTION

This invention is of a unique apparatus for display and protection of awards which employs a piece of luggage having a wall in which a slit is located and a transparent sheet attached to the outside of the wall so that the award may be inserted through the slit into a pocket defined by the transparent sheet and the outer surface of the wall. The pocket is sealed by a cover pivotally secured to the inside of the wall above the slit. A latch secures the cover in a closed position so as to seal the slit. In a second embodiment a pocket is formed between a transparent sheet and support member having a slit through which the award is inserted in the pocket and the support member is secured to the outside of a piece of luggage by double sided tape to seal the pocket and support the pocket on the luggage.

DISCUSSION OF THE DRAWINGS

This invention will be better understood from the following description in conjunction with the accompanying drawings, in which.

DESCRIPTION OF THE PREFERRED EMBODIMENT

Figure 1:
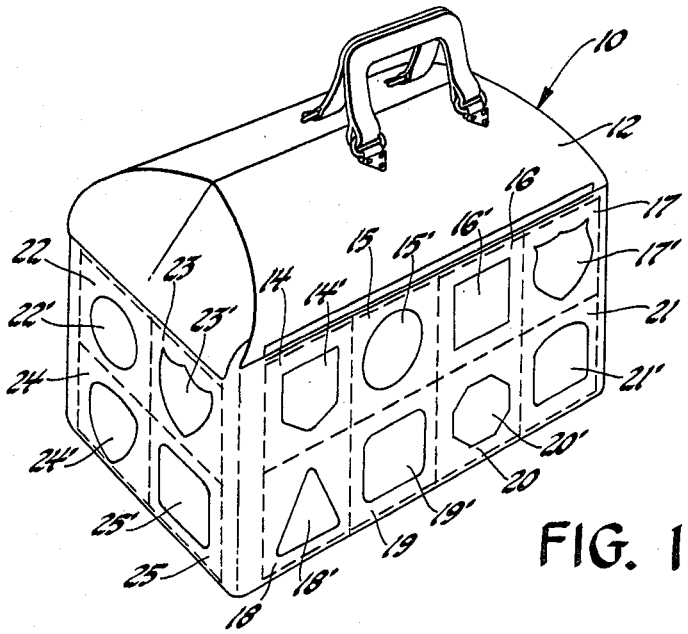
FIG. 1 is a perspective view of apparatus embodying the subject invention.

As shown in FIG. 1, the subject apparatus in the illustrated embodiment is in the form of a container such as a bowling bag 10. The bowling bag 10 includes a piece of luggage 12 on which twenty four pockets 14 through 37 are formed, of which pockets 14 through 25 are illustrated in FIG. 1. Pockets 14 through 37 contain awards 14' through 37', respectively, which may be of various configurations depending upon the collection acquired by the owner. The awards 14' through 37' are obtainable in various configurations including squares, circles, triangles, octagons, and hectagons.

Figure 2:
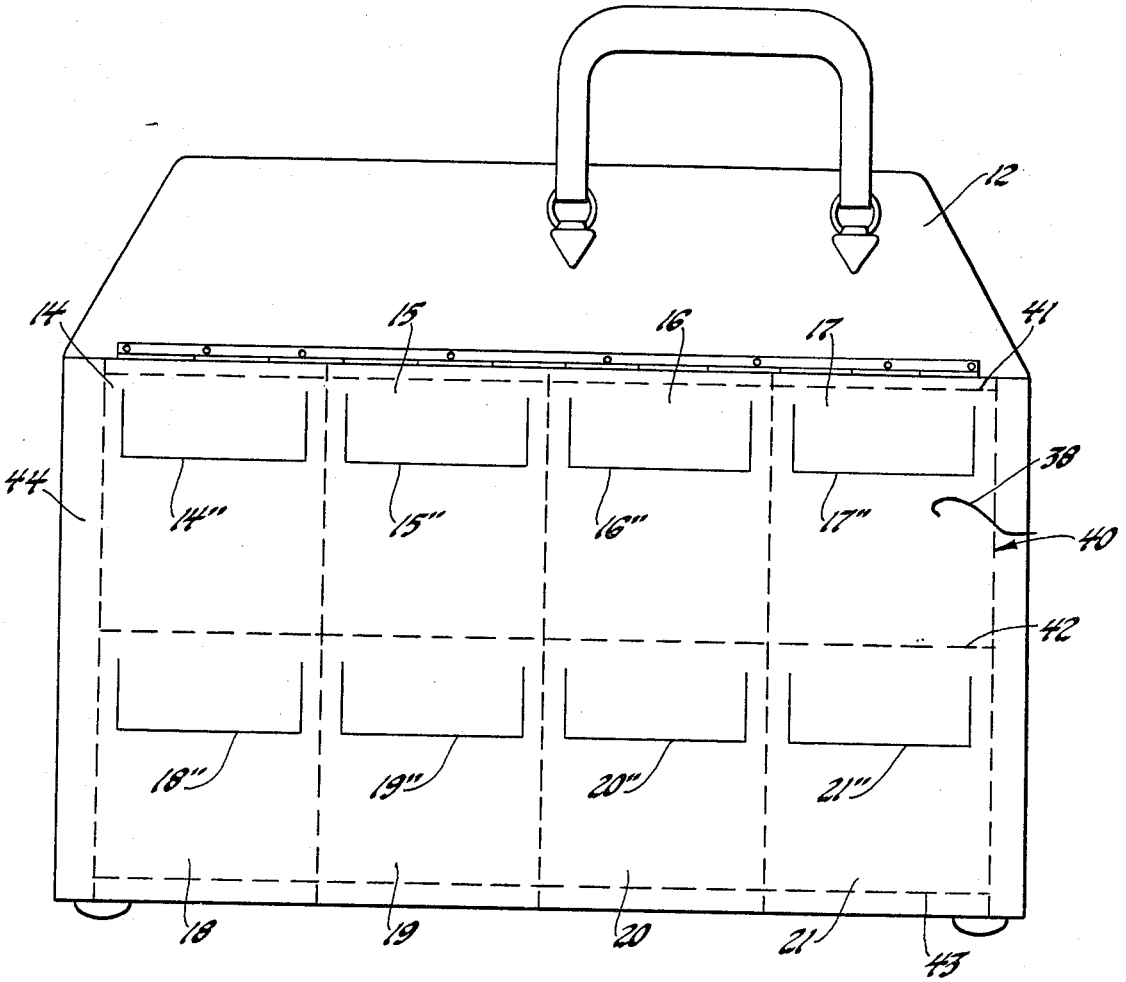
FIG. 2 is a side view of the apparatus in FIG. 1.

As shown in FIG. 2, the pockets 14 through 37 are formed by a substantially transparent sheet 38 that is stitched to the piece of luggage 12 by stitching 40 which includes three lines of horizontal stitching 41 through 43 which are connected by vertical stitching between each of the pockets 14 through 37.

As persons versed in the art will appreciate, the piece of luggage 12 may be of various types of construction. In the illustrated embodiment the piece of luggage 12 is of a type generally referred to as "soft sided" of a conventional design in which a relatively rigid frame defines the overall shape of the piece of luggage 12 and a relatively flexible piece of material, such as naugahyde, plastic, or leather is stretched on the frame and secured to the frame.

In FIG. 2 a side wall 44 of the piece of luggage 12 has an outer surface which is shown and an inner surface inside the piece of luggage 12. In the illustrated embodiment eight pockets 14 through 21 are formed by the stitching 40 attaching the transparent sheet 38 to the outer surface of wall 44. Persons versed in the art will appreciate that the number of pockets which may be formed on the wall 44 is discretionary and depends upon the need of the user and size of the awards 14' through 21' to be inserted in the pockets 14 through 21.

While the transparent sheet 38 may be of any suitable material, clear vinyl has been found to be most satisfactory. Depending upon the user's tastes, other materials may be employed for the sheet 38 but it is preferable that they be substantially transparent to permit easy viewing of awards in the respective pockets.

To facilitate insertion of awards 14' through 37' in pockets 14 through 37 a series of slits 14'' through 37'' are provided, one slit being provided in each pocket overlayed by transparent sheet 38. In the illustrated and preferred embodiment each of the slits 14'' through 37'' is in the form of a "U", resulting in a flap being formed in the wall adjacent each pocket.

Figure 3:
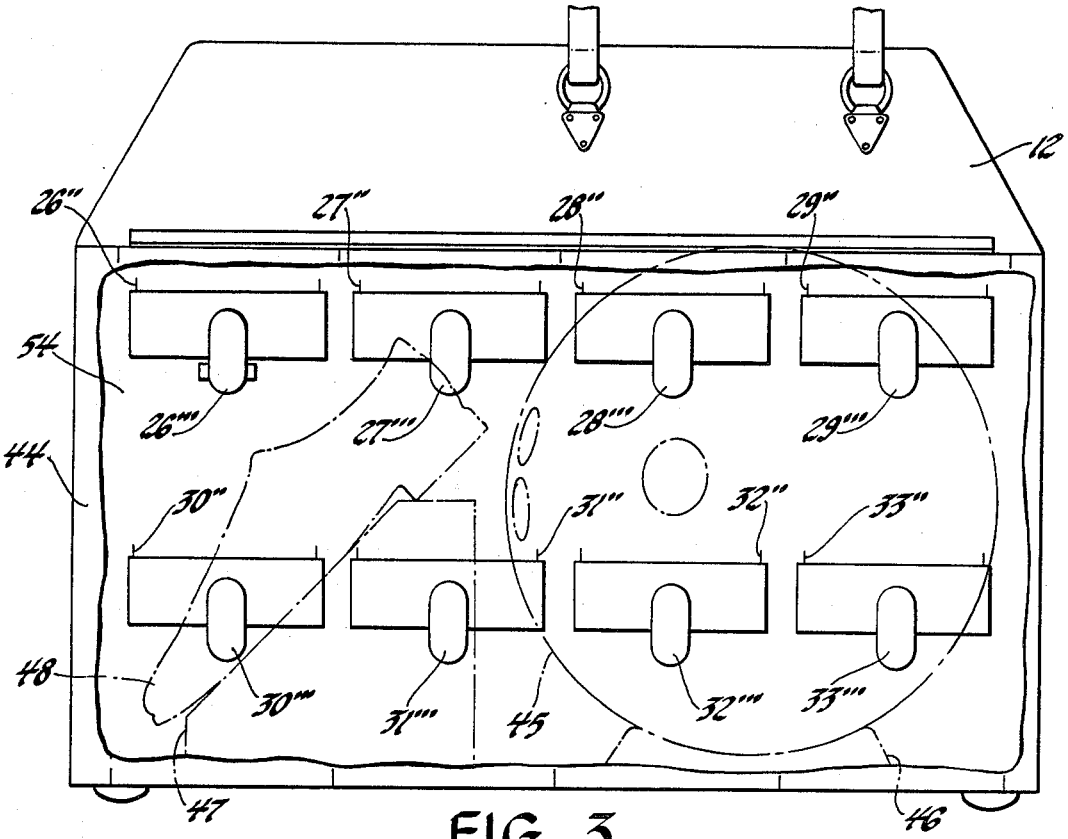
FIG. 3 is an interior view of the apparatus in FIG. 2 with the side removed.

FIG. 3 illustrates the interior of the piece of luggage 12 with the wall 44 removed. A bowling ball 45, a ball support 46, a hollow storage container 47 and a pair of shoes 48 are illustrated in phantom lines as they might appear in a typical bowling bag.

Each of the slits 14'' through 37'' may be securely sealed by a fastening mechanism 14''' through 37''' provided on the inside of each of the respective slits 14'' through 37''. Fastening mechanisms 26''' through 33''' are indicated in FIG. 3.

Figure 4:
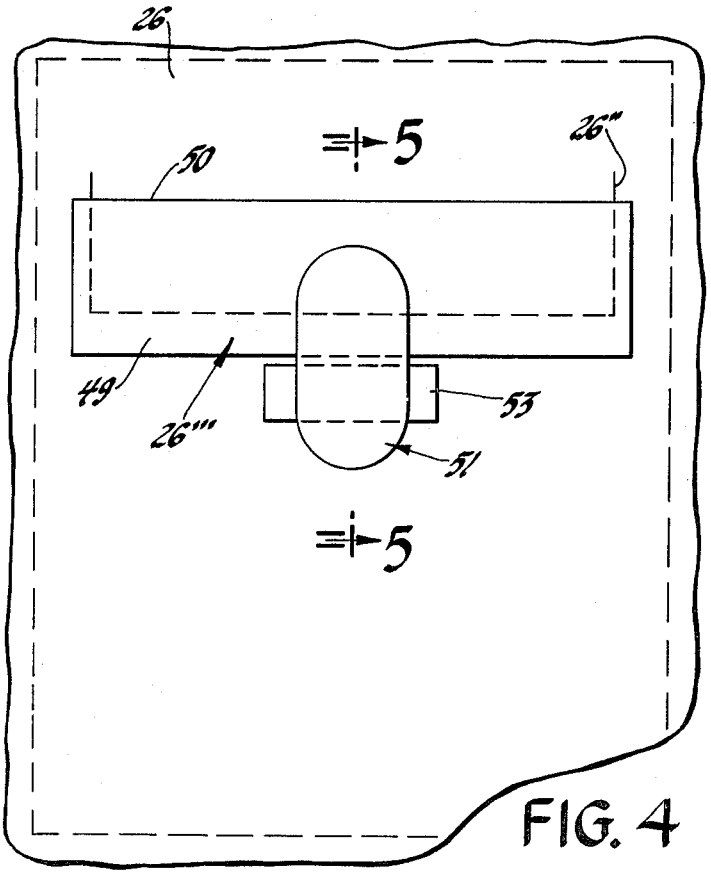
FIG. 4 is an enlarged view of a cover and latch illustrated in FIG. 3.

FIG. 4 is an enlarged view of the fastening mechanism 26''' illustrated in FIG. 3. Each of the fastening mechanisms 14''' through 37''' are identical.

As shown in FIG. 4, the fastening mechanism 26''' includes a cover 49 which is glued to the flap 50 formed by the slit 26''. The cover 49 may be of any semirigid material, such as a thin strip of hardboard or leather. It may also be made rigid if desired.

The purpose of the cover 49 is to seal the slit 26'' closed. The cover 49 is securely fastened to the flap 50, such as by use of glue or staples, so that gravity on the cover 49 pulls the cover 49 to the closed position indicated. To insert award 26' into the pocket 26 the cover 49 in merely lifted to its open position for insertion of the award 26 through the slit 26''.

If the fastening mechanism 26''' did not include the cover 49 dirt and other foreign objects could pass through the slit 26'' into the pocket 26 and be visible with the award 26'.

To prevent the passage of dirt and other objects into pocket 26 the cover 49 is securely held by a latch mechanism 51 which includes a first engagement member 52 secured to the cover 49 and a second engagement member 53 secured to the wall 54 of the piece of luggage 12.

Figure 5:
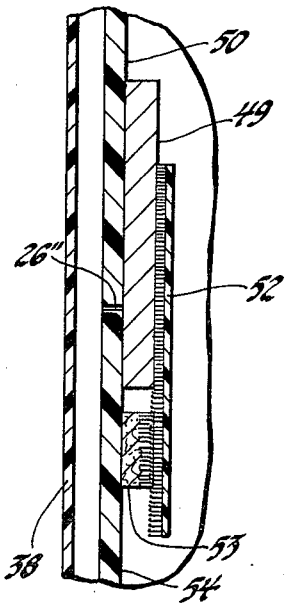
FIG. 5 is a section view of the cover and latch taken along the line 5—5 in FIG. 4.

The latch mechanism 51 in the illustrated embodiment may be easily seen by reference to FIG. 5. Persons versed in the art will appreciate that various apparatus may be used as the latch mechanism 51. However, in the illustrated embodiment the latch mechanism includes a first engagement member 52 in the form of a large strip of Velcro material having teeth pointed toward the wall 54 and a second engagement member 53 comprised of a second piece of Velco material having teeth pointed away from the wall 54. The first engagement member 52 may be securely fastened to the cover 49 through use of staples or glue. The second engagement member 53 may be securely fastened to the wall 54 through use of glue.

It is thus apparent that award 26' may be inserted in pocket 26 by grasping the first engagement member 52 and lifting it so as to pull the cover 49 to its open position in which the slit 26'' is exposed. The slit 26'' is then securely sealed by lowering the cover 49 and pressing the first engagement member 52 against the second engagement member 53 so they securely connect together. As persons versed in the art will appreciate, instead of Velcro material conventional zipper, snap and ring, or other devices could be used to securely latch the cover 49 in the closed position. The term "Velcro" is intended to include all fastening devices using numerous self engagement teeth regardless of manufacturer.

Figure 6:
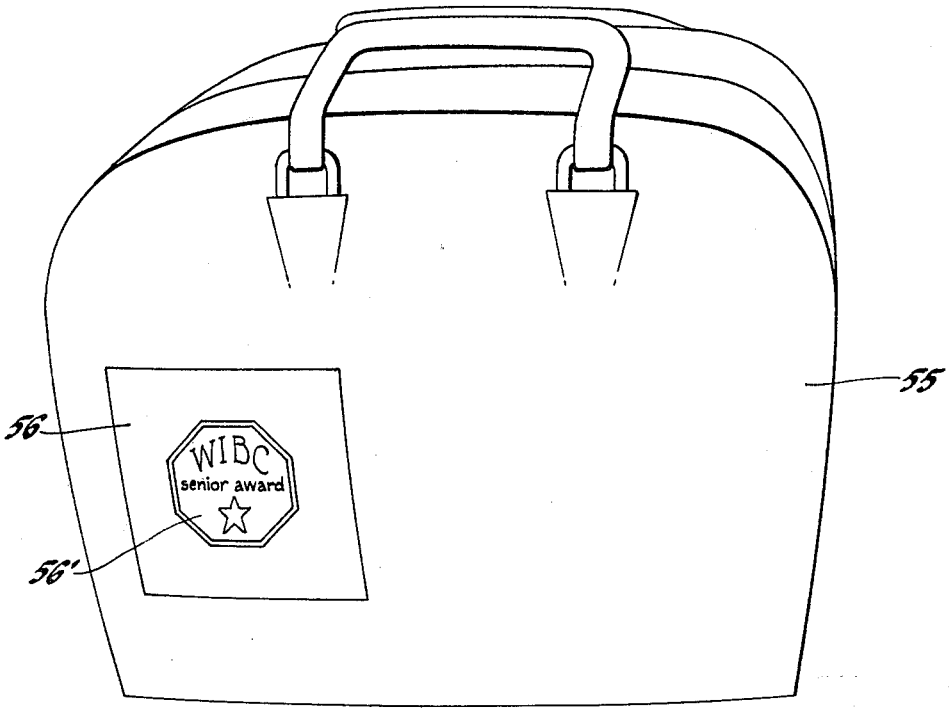
FIG. 6 is a perspective view of apparatus according to an alternative embodiment of the apparatus in FIG. 1.

In FIG. 6 a second embodiment of the subject invention is illustrated in which the piece of luggage 55 is a bowling bag of slightly different configuration than that previously indicated and an individual pocket 56 is provided containing an award 56'.

Figure 7:
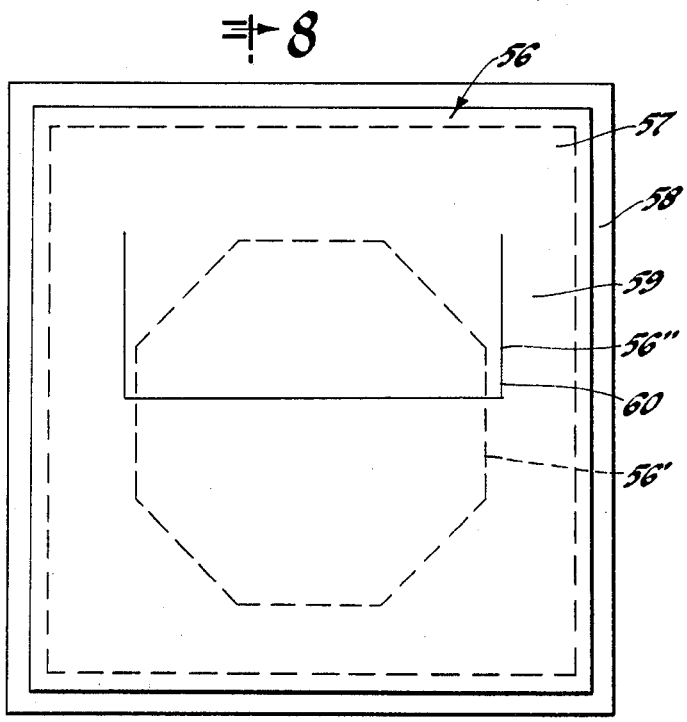
FIG. 7 is an enlarged plan view of the back side of a pocket shown in FIG. 6.
Figure 8:
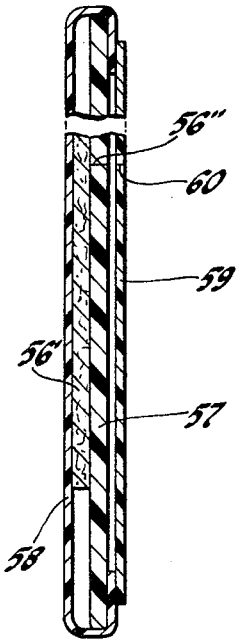
FIG. 8 is a section view of the pocket shown in FIG. 7 taken along the line 8—8.

FIGS. 7 and 8 show the detail of the individual pocket 56. FIG. 7 is a view of the backside of the pocket 56 which is secured to the piece of luggage 55. As shown in FIG. 7, a support member 57 is provided. The support member 57 in the preferred embodiment is made of a flexible material such as Naugahyde. Persons versed in the art will appreciate that semirigid material such as leather or a rigid material could also be used as the support member 57. A sheet 58 of transparent material such as clear vinyl overlays the front of the pocket 56 in FIG. 6 and is folded around the perimeter of the support member 57. A piece of double-sided tape 59 covers the entire backside of the support member 57 as indicated in FIG. 8. The double-sided tape on the side adjacent the support member 57 serves to securely fasten the edge of the sheet 58 to the support member 57. The double-sided tape also serves to attach the support member 57 securely to the piece of luggage 55. A slit 56" is provided in the support member 57 and a corresponding slit 60 is provided in the double sided tape 59.

To display and protect the award 56' the flap formed in the double sided tape 59 and support member 57 by the slit 56" is lifted. The award 56' is inserted through the slit 56" into the pocket 56. The flap is then lowered and the double sided tape 59 securely fastened to the piece of luggage 55 as illustrated in FIG. 6.

Double-sided tape is in common usage. It consists of a flexible strip having an adhesive coating on each side. To facilitate handling the pocket 56 it has been found best in practice to obtain double-sided tape having a thin slippery coating similar to waxed paper which may be peeled from the surface of the double-sided tape 59 immediately prior to pressing the tape 59 against the piece of luggage 55.

In the illustrated embodiment the support member 57 has an inner surface in FIG. 8 adjacent the double-sided tape and an outer surface adjacent the award 56'. The means for connection of the support member to the piece of luggage 55 in the illustrated embodiment is double-sided tape which covers the entire inner surface of the support member. Persons versed in the art will appreciate that the primary concern of the double-sided tape is to substantially surround the slit 56" so as to securely seal the slit closed and prevent dirt and other objects entering the pocket 56. To protect the pocket 56 and prevent its being accidently separated from the piece of luggage 55, as well as to secure the sheet 58 to the outer surface of the support member 57, it is preferable to have the double sided tape 59 cover the entire inner surface of the support member 57.

While the illustrated embodiments are the preferred embodiments, persons versed in the art will appreciate that various other configurations and apparatus may be used in the subject apparatus for display and protection of awards without departing from the spirit of this invention.

I claim:

1. Apparatus for display and protection of an award comprising a container having at least one wall and having an inner surface and an outer surface, at least one slit formed in said wall, said slit being large enough to allow passage of said award through said slit; a substantially transparent sheet; attachment means securing said sheet to said outer surface of said wall whereby a substantially enclosed pocket is formed between said sheet and said outer wall surface, said sheet being dimensioned so as to substantially overlay at least one of said slits; pocket sealing means secured to said inner surface for selectively sealing said pocket, said pocket sealing means having a first position in which said award may be passed through said slit into said pocket and a second position in which said slit is sealed closed so as to prevent passage of objects through said slit.

2. The apparatus of claim 1 in which said pocket sealing means includes a cover which substantially covers said slit so as to control passage of awards through said slit, said cover having an open position in which said award may be passed through said slit into said pocket and a closed position in which awards are substantially prevented from passing through said slit into said pocket, and a latch for securing said cover in said closed position.

3. The apparatus of claim 2 in which said wall is substantially vertical and said cover is pivotally connected to said inner surface above said slit whereby gravity pulls said cover to said closed position and said cover may be placed in said open position by lifting said cover and pivoting said cover about said pivotal connection and said latch includes a first engagement member secured to said cover and a second engagement member secured to said inner surface below said slit, said engagement members being adapted to latch when pressed together.

4. Apparatus for display and protection of an award comprising a container having at least one wall having inner and outer surfaces and at least one slit formed in said wall through which said award may be passed from said inner surface to said outer surface; a substantially transparent sheet; attachment means for securing said sheet to said outer surface of said wall so as to overlay said slit and form a pocket between said sheet and said outer surface, one side of said pocket being said outer surface and the other side of said pocket being said sheet; a cover secured to said inner surface so as to substantially cover said slit; said cover having open and closed positions, said open position permitting passage of said award through said slit and said closed position substantially preventing passage of said award through said slit; a latch secured to said inner surface proximate said cover for securing said cover in said closed position whereby said award may be inserted in said pocket for display and viewing through said sheet by placement of said cover in said open position and passing said award through said slit and said award may be protected therein by placing said cover in said closed position and latching said cover in said closed position to prevent passage of objects into said pocket.

5. The apparatus of claim 4 in which said sheet is sewn to said wall around said slit so as to define a pocket between said sheet and said outer surface of said object large enough to receive and display said award.

6. The apparatus of claim 4 in which said wall is substantially vertical and said cover is pivotally connected to said inner surface above said slit whereby gravity pulls said cover to said closed position and said cover may be placed in said open position by lifting said cover about said pivotal connection.

7. The apparatus of claim 6 in which said latch comprises a first engagement member secured to said cover and a second engagement member secured to said inner wall below said slit whereby said latch secures said cover in said closed position by connection of said engagement members so as to seal said pocket.

8. Apparatus for display and protection of an award comprising a container wall having an inner surface and an outer surface; a slit formed in said wall through which said award may be passed from said inner surface to said outer surface; a cover secured to said inner surface for selectively sealing said slit, said cover having an open position in which said award may be passed through said slit and a closed position in which objects are prevented from passage through said slit; a latch secured to said inner surface for selectively securing said cover in said closed position; and a transparent sheet secured to said outer surface so as to overlay said slit and form a pocket between said sheet and said outer suface whereby said award may be displayed by passing said award through said slit into said pocket and then sealing said slit by latching said cover closed so as to prevent passage of objects through said slit into said pocket.

9. The apparatus of claim 8 in which said wall is substantially vertical and said cover is made of a substantially rigid material pivotally connected to said inner surface above said slit so as to seal said slit closed when said cover is pulled downward by gravity and said slit may be uncovered for passage therethrough of said award by lifting said cover about said pivotal connection.

10. The apparatus of claim 8 in which said latch comprises a first engagement member secured to said cover and a second engagement member secured to said inner surface below said slit, said first and second engagement members being adapted to be securely latched by connecting them together so as to seal said pocket.

11. Apparatus for display and protection of an award comprising an object having an outside surface; a substantially two-dimensional support member having dimensions larger than said award, said support member being defined by an inner surface and an outer surface; a slit in said support member through which said award may be passed from said inner surface to said outer surface; a substantially transparent sheet; attachment means securing said sheet to said outer surface of said support member so as to overlay said slit and form a pocket between said sheet and said support member outer surface; and connection means for connecting said inner surface of said support member to said outside surface of said object so that said object outside surface overlays and seals said slit whereby said award is displayed and protected by inserting said award through said slit into said pocket between said sheet and said support member and then connecting said support member to said outside surface of said object.

12. The apparatus of claim 11 in which said connection means comprises a tape having adhesive on two opposed surfaces, one adhesive tape surface being secured to said inner surface so as to substantially overlay said slit and the other adhesive tape surface being secured to said outside surface of said object.

13. The apparatus of claim 11 in which said sheet is dimensioned larger than said support member and attached to said support member outer surface by folding the perimeter of said sheet onto said support member inner surface and attaching said sheet to said support member inner surface with a tape having two opposed adhesive surfaces, one adhesive tape surface securing said perimeter of said sheet to said support member inner surface by overlaying both said perimeter of said sheet and said inner surface of said support member, and in which said support member inner surface is connected to said object outside surface by the other of said adhesive tape surfaces being secured to said object outside surface.

* * * * *